United States Patent [19]

Thompson et al.

[11] 4,396,362

[45] Aug. 2, 1983

[54] CRYOGENIC RECIPROCATING PUMP

[75] Inventors: David R. Thompson, Kenmore; Boris Pevzner, Williamsville, both of N.Y.

[73] Assignee: Union Carbide Corporation, Danbury, Conn.

[21] Appl. No.: 202,476

[22] Filed: Oct. 31, 1980

[51] Int. Cl.[3] ..... F04B 39/08; F04B 15/08

[52] U.S. Cl. ..... 417/439; 417/53; 417/539; 62/55.5; 92/144

[58] Field of Search ..... 417/901, 53, 439, 437; 62/55.5; 92/144, 1; 165/81, 82; 285/114, DIG. 5, 226; 277/26; 74/18.2

[56] References Cited

U.S. PATENT DOCUMENTS

| | | | |
|---|---|---|---|
| 2,730,957 | 1/1956 | Riede | 103/153 |
| 2,888,879 | 6/1959 | Gaarder | 417/901 X |
| 3,083,648 | 4/1963 | Putman | 417/901 X |
| 3,136,136 | 6/1964 | Gottzmann | 62/55 |
| 3,263,622 | 8/1966 | Tyree, Jr. | 417/901 X |
| 4,036,618 | 7/1977 | Leonard et al. | 285/DIG. 5 |
| 4,156,584 | 5/1979 | Schuck | 417/435 |

*Primary Examiner*—William L. Freeh

*Attorney, Agent, or Firm*—Eugene Lieberstein

[57] ABSTRACT

The cryogenic reciprocating pump includes a pump body having a cylindrical pumping chamber extending from the forward end of the pump body to the pump body rearward end. A piston is reciprocated in the pumping chamber under the control of a piston rod extending from the pumping chamber. A packing assembly surrounds the piston rod and is coupled through an intermediate section to the rearward end of the pump body. The intermediate section comprises a tubular shell of low thermal conductivity material and a corrugated metal expansion member. The packing assembly is affixed to a support member connected to the pump body at the forward end thereof.

11 Claims, 1 Drawing Figure

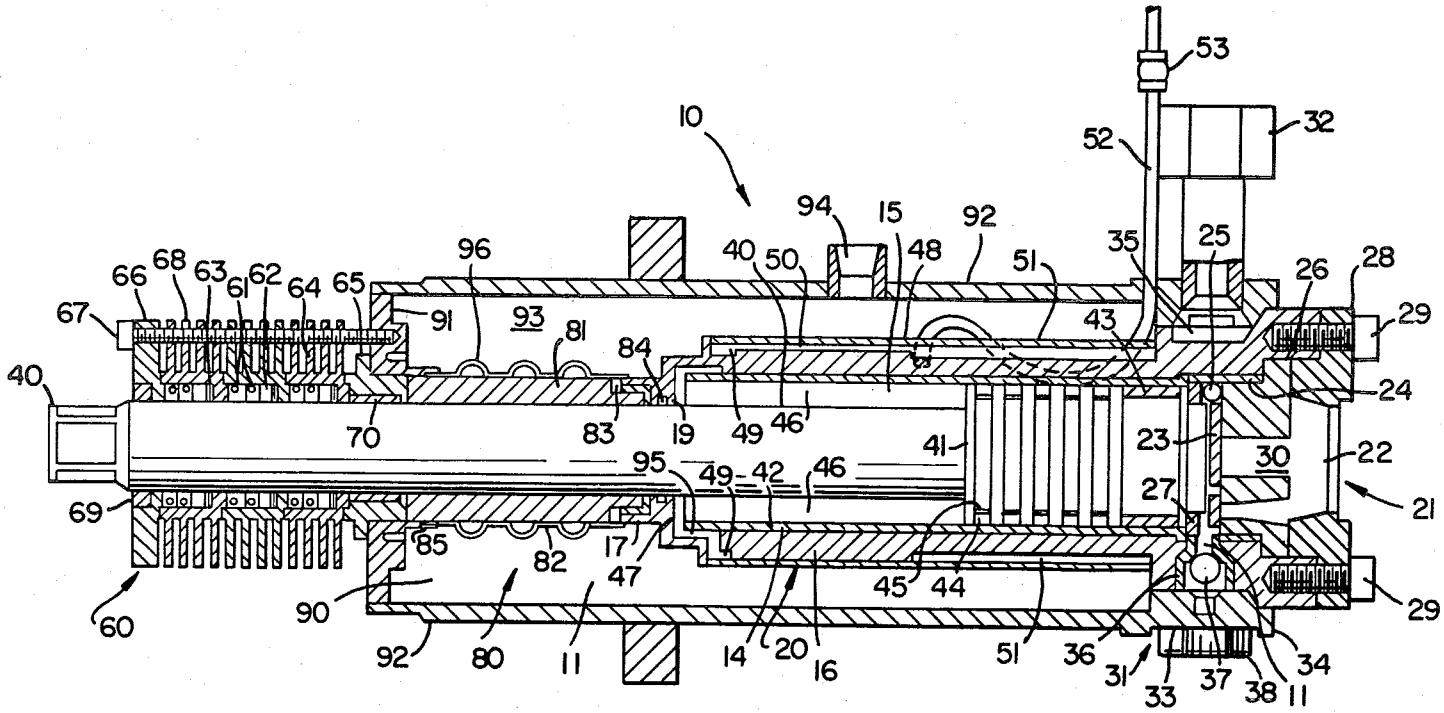
10
11
14
15
16
17
19
20
21
22
23
24
25
26
27
28
29
30
31
32
33
34
35
36
37
38
40
41
42
43
44
45
46
47
48
49
50
51
52
53
60
61
62
63
64
65
66
67
68
69
70
80
81
82
83
84
85
90
91
92
93
94
95
96

CRYOGENIC RECIPROCATING PUMP

This invention relates to cryogenic apparatus for pumping a highly volatile liquid having a boiling point temperature at atmospheric pressure, substantially below 273° K. More specifically this invention relates to an improved reciprocating type cryogenic pump for pumping cryogenic liquids such as liquefied nitrogen or oxygen and particularly at high pressure and flow rate.

The pumping of cryogenic liquids presents some difficult problems. Most of these problems stem from the relatively unique physical properties of cryogenic liquids, such as their high compressibility and volatility, as well as the low temperatures involved. While the prior art has minimized many of these problems in low pressure and/or low flow cryogenic pumps, the prior art has been unable to provide a "high flow" and/or "high pressure cryogenic pump" having a "high volumetric efficiency" and a "low required net position suction head" (NPSH). In this context, "high flow" refers to cryogenic pumping rates in excess of about 15 gal./min./pumping chamber at pumping conditions. Also in this context, the term "high pressure cryogenic pump" is meant to include pumps which provide the pumped liquid at pressures above about 500 psig. And for purposes of this invention, the term "high volumetric efficiency" means volumetric efficiencies above about 80%. Volumetric efficiency is defined as the ratio of the actual pump capacity to the volume displaced by the piston per unit time times 100 percent. Finally, the term "low required NPSH" means a required NPSH below about 10 psid.

It has been recognized by those skilled in cryogenic pump technology that heat conduction from the cryogenic pump warm end to the pumping chamber portion of the pump body represents a significant contributor to pump inefficiency. Based on this recognition, the prior art has proposed both functional and design solutions.

The principal prior art approach has been to try and intercept the heat conducted from the warm end of the pump by heat exchange with a cold fluid. While such designs can effectively prevent major problems such as vapor binding which would normally accompany an inordinant heat flux to the cold end of the pump, these approaches have their disadvantages. Primarily, it is not feasible to precisely control the amount of cooling and in many cases, the warm end of the pump actually becomes too cold for proper packing performance or frost may form and destroy the packing. Consequently, in many circumstances auxiliary heating is necessary to allow continued troublefree operation. This heating represents an additional and otherwise unnecessary heat load on the pump. Moreover, in prior art designs the pumping chamber portion of the pump body is integral with the packing assembly which allows for significant conduction between the warm packing assembly and the pumping chamber.

It is an object of this invention to provide a reciprocating-type cryogenic pump capable of pumping a cryogenic liquid at a high pressure and at a high flow rate which does not require auxiliary heating of the packing assembly.

It is another object of this invention to provide reciprocating-type cryogenic pump which minimizes the conduction of heat between the warm and cold ends of the pump.

Other objects and advantages of the present invention will become apparent from the following disclosure when read in connection with the accompanying drawing which is a cross sectional view of a reciprocating cryogenic pump constructed in accordance with the present invention.

Referring now to the drawing, cryogenic pump 10 comprises three main sub-sections including a tubular pump body 20; a packing assembly 60 and an intermediate section 80 which couples the pump body 20 to the packing assembly 60 to control heat transfer therebetween as will be explained in more detail hereafter.

The pump body 20 is of a generally tubular construction having a cylindrical bore 14 forming a pumping chamber 15 within which a piston 41 is reciprocated, the piston 41 is connected to a piston rod 40 which is coaxially arranged with the longitudinal axis of the pump body 20 and extends outwardly from the pumping chamber 15 through the intermediate section 80 and the packing assembly 60 where it is adapted to be connected to any conventional mechanism such as a crankshaft for effecting reciprocation of the pumping elements.

Although it is preferred for the piston rod 40 to have a diameter which is of a predetermined size smaller than the diameter of the piston 41 so as to form a variable volume annulus 46 this is not an essential requirement of the present invention. The variable volume annulus 46 is a preferred means for collecting blow-by fluid leaking around the piston 41 during each discharge stroke as taught in a corresponding Patent application U.S. Ser. No. 202,475 entitled Cryogenic Pump and Method for Pumping Cryogenic Liquids, filed by applicants on even date herewith; the disclosure of which is herein incorporated by reference.

In order to ensure trouble free operation of the pump, the piston 41 must be properly aligned within the pumping chamber. It is preferred that the bore 14 be formed in a central body 16 of stainless steel with an inner sleeve liner 42 securely mounted thereto or shrunk fit thereon and upon which the piston 41 is to ride. The inner sleeve liner may be composed of a polished type 17-4PH stainless steel. Sealing between the piston 41 and the cylindrical liner 42 is accomplished with the piston 41 outfitted with the piston rings 44 preferably composed of carbonfilled teflon and energized into an activated state in biased engagement against the cylindrical liner 42 by beryllium-copper ring-type springs 45. The piston 41 is guided at its front end thereof for movement within the pumping chamber 15 by a rider ring 43 typically of carbon-filled teflon. The primary function of the rider ring 43 is to ensure proper piston positioning both during assembly and operation. The piston rod 40 is also guided with an alignment bushing 70 located between the intermediate section 80 and the packing assembly 60.

Cryogenic fluid enters the cryogenic pump 10 through an inlet port 22 under the control of a suction valve assembly 21. The suction valve is of the conventional disk or plate valve type including a plate valve, 23 which is laterally guided by means of a valve cage 24 and balls 25. The plate valve 23 rests on the suction valve seat assembly 26. Openings 30 are provided in the suction valve seat assembly for permitting cryogenic fluid to flow therethrough during the suction stroke. The movement of the plate valve during the suction stroke is restricted by the suction valve retainer ring 27.

The entire suction valve assembly 21 is secured by a flange 28 to the pump body 20 using head bolts 29.

Cryogenic fluid is discharged through a discharge port 11 under the control of a discharge valve assembly 31. The discharge valve assembly 31 includes a discharge manifold 33 secured to the pump body 20. The discharge manifold 33 is provided with six equally spaced openings. Five of the openings are provided with the ball valve assemblies 34; while the sixth opening is fitted with a discharge connection 32. An annular discharge conduit 35 is formed between the pump body 20 and the discharge manifold 33. Five of the openings in the discharge manifold 33 are directly aligned with five openings provided in the lower portion of the pump body 20. The ball valve assemblies 34 are inserted into each of these latter openings. Each ball valve assembly 34 consists of a valve seat 36 together with a stainless steel valve ball 37. The valve seat may be held in place by threading it into the openings in the pumping chamber. The discharge valve retainer 38 permits the installation of valve seat 36 and restricts the movement of the valve ball 37. The suction valve assembly 21 and the discharge valve assembly 31 are actuated by the piston 41 in a conventional manner which will be briefly explained hereafter.

The tubular pump body 20 is coupled to the packing assembly 60 through an intermediate section 80 which comprises the combination of a tubular spacer element 81 and an expansion member 82. The tubular spacer element 81 is a material of low conductivity such as polytetrafluoroethylene which can be conveniently molded or machined. The tubular spacer 81 surrounds the piston rod 40 and is sandwiched between the rearward end of the pumping chamber and the packing assembly 60. One end of the tubular spacer 81 fits into a seal retainer ring 83 which holds a sealing ring 84 in place while the other end abuts the bushing retainer 65 of the packing assembly 60. The sealing ring 84 limits the egress of cold gas and liquid from the variable volume annulus 46 axially along the piston rod 40. The conductivity spacer 81 prevents any gas that does leak through seal 84 from forming convective currents in this region which would significantly increase the unwanted heat exchange between the pumping chamber and the packing assembly.

The tubular spacer 81 is surrounded by the expansion member 82, which joins the tubular pump body 20 to a flange 91 to which the packing assembly 60 is also attached. One end of member 82 is welded to lip 85 extending from the flange 91 while the other end of this member is welded to the lip 17 extending from the body. In this preferred embodiment, the expansion member 82 is a thin-walled stainless steel cylinder provided with a series of spaced circular-contoured ribs or bellows 96. The thin-walled construction of the expansion member minimizes the axial heat conduction therethrough between the packing assembly 60 and the pumping chamber 15. The combination of the low conductivity spacer 81 and the expansion member 82, therefore, represents a significant contributor to satisfying heat management problems in the cryogenic pump.

It is essential that the expansion member 82 have a wall thickness of less than 0.18 inches and preferably no thicker than 0.05 inches. The length of the intermediate section 80 measured longitudinally between the pump body 20 and the packing assembly 60 shall span a distance at least about equal to the axial distance swept by the piston 41 in the pumping chamber 15.

The tensile loading on the tubular pump body 20 caused by the internal pump pressure is transmitted by the outer jacket 92 surrounding the pumping chamber and the intermediate section 80 to a supporting member 97. The outer jacket may be fabricated from type 304 stainless steel. The outer jacket 92 connects the supporting flange 91, to which the warm packing assembly 60 is fastened, to an extended flange on the discharge manifold 33 of the pump body 20. The outer jacket 92 is spaced from the tubular pump body 20 so as to form an annular insulation space 93. This insulation space is preferably filled with a low conductivity material such as expanded perlite. Additionally, the insulation space may be evacuated, as will be readily recognized by one of normal skill, to provide a vacuum insulation.

In this design, the thermal expansion caused by the temperature differential established between the cold body and the warm outer jacket of the pump, is allowed for through the use of the expansion member 82. The inlet fluid can flow through openings 30 and then either around the periphery of plate valve 23 or through the plate valve perforation into the pump compression chamber. Preferably, the pump is assembled with the expansion member under compression as this reduces the stresses in this member during operation. The bellows 96 in the member 82 allow for the differential expansion/contraction of the tubular pump body. Accordingly, the tensile stress imposed on the pump body is significantly reduced and the major portion of the tensile load is instead, transferred through the outer jacket 92 to the supporting member 97. Because the tensile load is effectively removed from the tubular pump body 20, the wall thickness of the central body 16 in which the pumping chamber 15 is formed can be minimized. Additionally, the pumping chamber 15 is now only subject to hoop stress permitting the weight of the pump 10 and accordingly its thermal inertia to be reduced.

The packing assembly 60 seals the warm end of the cryogenic pump 10. The packing assembly consists of three sets of sealing rings 61, packing thrust washers 62 and wave washers 63. The sealing rings may be made from carbon-filling teflon. Each set of sealing rings, packing thrust washers and wave washers are installed between the individual packing glands 64. The entire packing assembly is piloted into the piston alignment bushing retainer 65, which in turn is seated in the flange 91. The packing is retained in position by the packing gland retainer 66 and the elongated head bolts 67. A wiper-scraper 69 is inserted into an annular slot in the packing gland retainer 66. The packing assembly is surrounded by heat transfer fins 68 which in this embodiment are integral with the individual packing glands 64.

Blow by fluid is permitted to leak around the piston 41 during its discharge stroke and collect in the variable volume annulus 46 formed about the piston rod 40 between the rearward end 19 of the tubular pump body 20 and the piston 41. The cylindrical liner 42 terminates at a position within the pumping chamber 15 just short of contacting the rearward end 19 of the tubular body 20 so as to provide an open clearance 47 leading to an annular passageway 95. The annular passageway 95 communicates with the annular space 49 which in turn communicates through an axially aligned groove 50 to a cooling jacket 51.

The cooling jacket 51 completely surrounds the central pump body member 16 and liner 42 and is bounded by an outer tubular sleeve 48. The fluid is exhausted from the cooling jacket 51 through a vent 52 under the control of a check valve 53, or other restricting medium which will control back flow into the cooling jacket.

The steady state operation of the pump 10 will now be described with the piston 41 assumed to be at the end of its discharge stroke and with the suction and discharge valves closed. As the piston 41 moves away from the suction valve assembly 21 the inlet valve 21 opens and cryogenic liquid is permitted to flow through the inlet opening into the pumping chamber 15. The discharge valve 31 remains closed because of the high pressure existing on the opposite side of the valve balls 37. As the piston 41 continues to move away from the suction valve assembly, the pumping chamber becomes filled with the cryogenic liquid. Movement of the plate valve 23 is restrained by the retainer ring 27.

Once the piston 41 reaches the limit of its suction stroke its direction of movement is reversed. Upon initiation of the discharge stroke, the compressive force exerted on the cryogenic liquid within the pumping chamber causes the suction plate valve to seat upon the valve seat assembly 26, thereby closing the suction valve assembly. As the cryogenic fluid is further compressed during the discharge stroke of the piston, the discharge valve assemblies 31 are eventually actuated. The ball valve 37 is forced outwardly to the discharge valve retainer 38 thereby establishing communication between the pumping chamber and the annular discharge conduit 35. The pressurized cryogenic liquid flowing into the annular discharge conduit is then discharged through the discharge connection 32.

Simultaneously with the discharge stroke of the pump, blow-by fluid collects in the expanding variable volume annulus 46. Since the volume of the variable volume annulus 46 is increasing much more rapidly than the volume rate of flow of the blow-by fluid into this annulus, a portion of the blow-by fluid liquid flashes (vaporizes) upon passing into the expanding annulus. Since this flashing occurs under essentially adiabatic conditions, the latent heat of vaporization must come from the sensible heat content of the liquid itself. Consequently, the temperature of the liquid remaining in the expanding annulus decreases. This cooled liquid helps to remove both the frictional and compressional heat generated within the pumping chamber. Moreover, this liquid also helps to remove heat conducted along the piston from the warm end of the pump.

As the piston returns to the position illustrated in the drawing, the discharge valve once again closes. The pump cycle is then repeated. During the subsequent suction stroke, any blow-by fluid that has collected in the previously expanding variable volume annulus is now forced to flow therefrom as the annulus begins to contract. This fluid is pushed through the open clearance 47 into the annular space 95 from whence it flows up and around the annulus 49, through the axially extending conduit 50 and into the cooling jacket 51. Upon entering the cooling jacket 51 the gas and liquid phases of the fluid tend to separate and the gas collects in the upper region of the cooling jacket 51. Some blow-by gas separated in the cooling jacket from a previous pumping cycle is then forced by this new fluid through the vent conduit 52 and past the check valve 53. This gas may be returned to the source of the cryogenic liquid or may be vented to the atmosphere.

At the end of the suction stroke, the cooling jacket is substantially filled with the blow-by liquid. As the discharge stroke is begun, the volume of the interconnected annular cooling jacket and variable volume annulus expands rapidly. Since there is a very small pressure drop between the expanding annulus and the cooling jacket, gas is drawn from the fixed volume cooling jacket thereby lowering the pressure therein. This pressure reduction causes the blow-by liquid within the annular cooling jacket to boil. Since this boiling occurs under essentially adiabatic conditions, the latent heat of vaporization must come from the sensible heat content of the fluid itself. Consequently, the temperature of the liquid within the cooling jacket decreases. This so-cooled fluid then acts as an additional heat-sink for the frictional and compressional heat generated during the operation of the pump.

Although a preferred embodiment of this invention has been described in detail, it will be appreciated that other embodiments are contemplated along with modification of the disclosed features as being within the scope of the invention. By way of illustration, the pump could be constructed with the piston and piston rod representing a continuous body of constant diameter. In such case the spacer 81 may be eliminated leaving the intermediate section 80 represented solely by the expansion member 82 which would then be mounted around the body of the piston.

We claim:

1. A reciprocating cryogenic pump for pumping cryogenic liquids at relatively high pressure and flow rate comprising: a tubular pump body having a forward end and a rearward end; a cylindrical bore internal of said pump body for forming a pumping chamber therein extending from the forward end to the rearward end of said pump body; a reciprocating piston slidably disposed within said pumping chamber and a piston rod extending from said piston through the rearward end of said pump body along the longitudinal axis of said pump; valve means disposed at the forward end of said pump body for controllably introducing cryogenic liquid into said pumping chamber during the suction stroke of said piston and for controllably discharging cryogenic liquid from said pumping chamber during the discharge stroke of said piston; packing means laterally spaced a predetermined distance from the rearward end of said pump body in surrounding engagement with said piston rod; a thin metal expansion member having at least one corrugation for thermally coupling the rearward end of said pump body to said packing means; and load carrying support means common to said packing assembly and said pump body for relieving the tensile loading from said pump body, said load carrying support means comprising an outer jacket surrounding said pumping chamber and interconnecting only the forward end of said pump body to said packing assembly.

2. A reciprocating cryogenic pump as defined in claim 1 wherein said predetermined distance separating said packing means from said rearward end of said pump body is equal to at least the stroke length traveled by said piston in said pumping chamber.

3. A reciprocating cryogenic pump as defined in claim 2 wherein said thin metal member has a thickness of less than 0.18 inches.

4. A reciprocating cryogenic pump as defined in claim 3 wherein said coupling means further comprises a tubular shell of a material of low thermal conductivity surrounding said piston rod between the rearward end of said pump body and said packing means and wherein said thin metal member surrounds said low thermally conductive tubular shell.

5. A reciprocating cryogenic pump as defined in claim 4 wherein said tubular shell is composed of polytetrafluorethylene.

6. A reciprocating cryogenic pump as defined in claim 5 wherein said support means further comprises a flange connecting said thin metal member to said packing means and wherein said jacket means has one end connected to said flange and an opposite end connected to said pump body at the forward end thereof.

7. A reciprocating pump as defined in claim 6 wherein said jacket means is tubular in geometry and concentrically arranged about said pump body and further comprising an insulating low conductivity material disposed within the space separating said jacket means and said pump body.

8. A reciprocating pump as defined in claim 7 wherein said insulating material is composed of perlite.

9. A reciprocating pump as defined in claim 7 wherein said space separating said jacket means and said pump body is evacuated to form a vacuum.

10. A reciprocating pump as defined in claim 6 wherein said piston has a diameter larger than the diameter of said piston rod thereby forming a variable volume annulus in said pumping chamber about said piston rod in which blowby fluid collects.

11. A reciprocating pump as defined in claim 10 further comprising; an annular cooling jacket surrounding said pumping chamber, passageway means connecting said cooling jacket to said variable volume annulus such that said blowby fluid is passed from said variable volume annulus into said cooling jacket during consecutive suction strokes and caused to flash during consecutive discharge strokes and vent means for controllably discharging blowby fluid from said cooling jacket.

* * * * *